United States Patent [19]

Dearien, Jr.

[11] Patent Number: 4,828,118

[45] Date of Patent: May 9, 1989

[54] CONTINUOUS PAPER FEEDER AND COLLECTOR

[76] Inventor: John A. Dearien, Jr., 2329 Belmont, Idaho Falls, Id. 83401

[21] Appl. No.: 63,988

[22] Filed: Jun. 18, 1987

[51] Int. Cl.[4] ..... A47F 7/00

[52] U.S. Cl. ..... 211/50; 211/13; 248/176

[58] Field of Search ..... 211/50, 13, 126, 129, 211/55; 248/441.1, 442.2, 454, 176; 312/196

[56] References Cited

U.S. PATENT DOCUMENTS

| | | | |
|---|---|---|---|
| 972,709 | 10/1910 | Nelson | 211/50 X |
| 1,525,445 | 2/1925 | Hamilton | 211/50 X |
| 4,163,497 | 8/1979 | McEwen | 211/11 |
| 4,544,065 | 10/1985 | Mueller | 211/13 |
| 4,570,802 | 2/1986 | Murphy | 211/50 X |
| 4,611,719 | 9/1986 | Dudek et al. | 211/50 |

FOREIGN PATENT DOCUMENTS

| | | | |
|---|---|---|---|
| 311989 | 5/1929 | United Kingdom | 248/454 |

*Primary Examiner*—Robert W. Gibson, Jr.

[57] ABSTRACT

An apparatus in the form of a paper holder intended for use with, for instance, personal computer printers or any printing machine using continuous form paper. The paper holder stores the paper prior to use by the printer and stores the paper after being printed. The paper holder is designed for use with a printer where space behind the printer is restricted and where conventional paper holders will not fit.

3 Claims, 6 Drawing Sheets

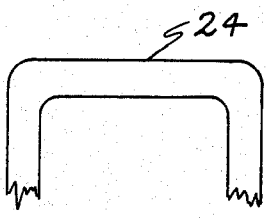
Figure 10-a
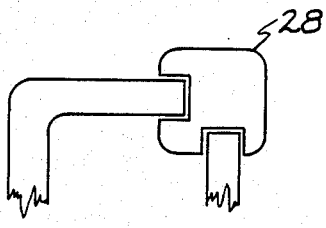
Figure 10-b
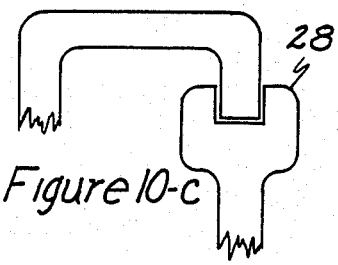
Figure 10-c
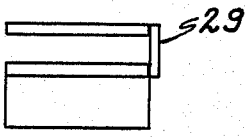
Figure 11
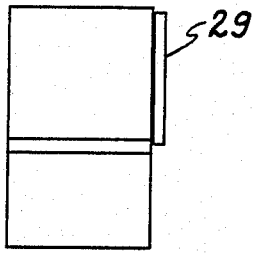
Figure 12
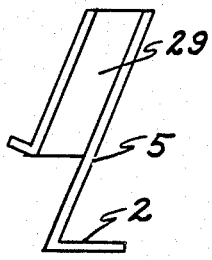
Figure 13
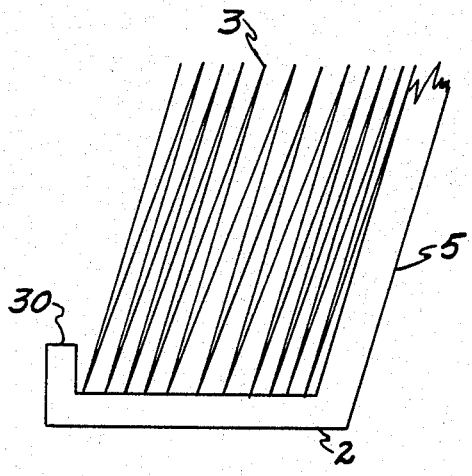
Figure 14
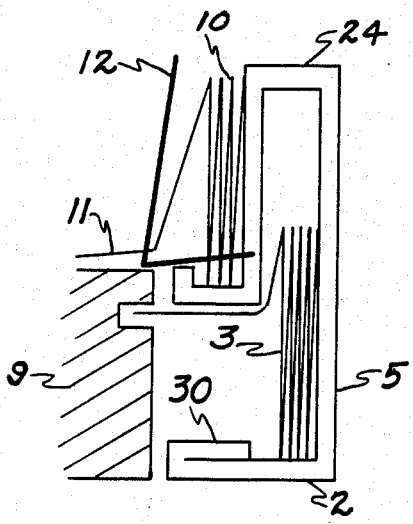
Figure 15

CONTINUOUS PAPER FEEDER AND COLLECTOR

SUMMARY

This invention is an apparatus for storing printer paper before and after printing and is designed to (1) sit behind the printer where a minimum of space is available and (2) collect the paper after printing in such a manner as to allow the user to read the output as it is printed.

The paper holder is shown in side view in FIG. 1. The paper holder is constructed in a shape that permits storage of the paper in a near vertical to vertical position before and after printing. This near vertical to vertical storage of the paper allows the paper holder to store computer paper without using as much horizontal desk space as other paper holders.

Supply paper restraint bails and printed output paper restraint bails are attached to the body of the paper holder to restrain the paper while it is stored prior to use and after it is printed.

The paper holder is designed such that no attachment to the printer is required for operation of the paper holder.

The shape of the paper holder is designed such that multiple units of the holder can be nested for storage and shipping.

The printed output paper collection tray of the invention may be used as a copy holder to hold sheets of material to be typed while the invention in not in use as with the printer.

BACKGROUND OF THE INVENTION

There are many devices on the market to hold the paper supply for computer printers and to catch the paper after printing. Most of these devices require an area behind the printer at least as large as the horizontal area of the computer paper when the paper is lying flat. This requires a distance of at least 11 inches behind the printer. There are two products commercially available which conserve space behind the printer by (a) storing both the paper supply and the output paper under the printer or by (b) storing the supply paper under the printer and the output paper above the printer. The advantages of the present invention over each of the available products is discussed below:

There is a product currently available through most computer supply catalogs which is designed with two horizontal trays to hold the printer supply paper and the output paper, one tray above the other. The printer sits on top of the product, thus conserving space behind the printer. The supply paper is pulled from the lower tray into the printer and, after printing, is fed into the upper tray through a guided pathway. When the printing process is finished, there is printed output extending from the printer roller through the guided pathway to and into the collection tray beneath the printer. To retrieve the printed output it is necessary to separate the paper at the printer roller, feed the paper through the guided pathway into the collection tray and then retrieve the paper from the collection tray. The paper must be retrieved from the collection tray through the side of the product, thus requiring a clear space beside the printer in order for users to get their hands into the collection tray and remove the paper from the collection tray.

The advantages of the present invention over this commercially available product are:

(1) no attachment to the printer is required (2) the supply paper in the present invention is stored behind the printer in a near vertical position. The printer does not have to be moved or reoriented in order to utilize the present invention.

(3) there is no guided pathway linking the paper coming out of the printer to the printed output paper collection tray. The output paper from the printer feeds directly from the printer roller to the near vertical printed output paper collection tray. This saves the user the problem of feeding the output paper into the guideway.

(4) The distance from the printer roller to the collection tray of the present invention is less than half the length of a sheet of output paper. In the commercial product described above, there are two to three pages between the printer roller and the collection tray. This length of paper between the printer roller and the collection tray requires that the user either eject blank paper through the printer to drive the output into the collection tray or tear off the paper at the printer roller and push it through the guideway. In the present invention, there is no paper waste and no requirement to push the final sheets of paper through a guideway into the collection tray.

(5) No additional space is required around the printer to allow user access to the printed output. The output paper is in an open, nearly upright printed output paper collection tray in front of the user and the output paper is retrieved simply by pulling up on the output paper and tearing it along the paper perforations.

Another product, produced by the AMERI*PAC Division of Bankier Companies, Inc. and sold under the trademark TOP*DECK, is designed only to catch the printed output from a small printer. Accommodation of the paper supply and paper delivery to the printer must be taken care of by separate means. The company does offer an optional printer stand, typical of many commercial products, in which the paper supply is stored under the printer. The paper storage and supply device, however, is not part of the protected (patent pending) paper catcher device. The TOP*DECK product takes the output from the printer and transfers it through a guideway to a tray located directly above the printer. The guideway is of a length such that from two to three pages of output must be produced before stacking begins in/on the collection tray. Likewise, when printing is finished, two to three pages of output remain within the guideway. Legs attached to the TOP*DECK paper catcher allow it to sit on the work table independent of the printer.

The advantages of the present invention over the TOP*DECK product are:

(1) The present invention includes provisions for storing the supply paper and delivering the paper to the printer as it is needed.

(2) The present invention stores the paper supply and the printed output paper in a near vertical position behind the printer and does not restrict access to the printer from above.

(3) The present invention stores the printed output paper within (more or less) one half a paper length from the printer roller and thus does not have to fill up a two to three sheet guideway before it is accessible from the collection tray. The disclosed invention saves paper relative to the TOP*DECK product if it is necessary for the TOP*DECK user to form feed two or three blank pages through the printer in order to push the printed output into the collection tray.

(4) The present invention allows the user to read the printed output as it comes out of the printer. It does not appear to be possible, or at least very easy to read the printed output with the TOP*DECK collector due to the overhanging collection tray and the guideway that directs the paper into the collection tray.

BRIEF DESCRIPTION OF THE DRAWINGS

FIGS. 10-*a*, 10-*b*, 10-*c* shows alternate embodiments of the connection joint between the supply paper tray and the printed output paper tray;

FIG. 11 is a top view of the present invention with the printed output paper tray and the supply paper tray connected by a side panel;

FIG. 12 is a front view of the present invention with the printed output paper tray and the supply paper tray connected by a side panel;

FIG. 13 is a side view of the present invention with the printed output paper tray and the supply paper tray connected by a side panel;

FIG. 14 is a view of the base of the present invention in a configuration where the base retains the supply paper in an upright position;

FIG. 15 is a side view of the present invention in a configuration where both the supply paper tray and the printed output paper tray are in a vertical orientation;

DETAILED DESCRIPTION OF THE INVENTION

It is to be understood that while the present invention is described herein primarily in the environment of personal computers, the invention is equally susceptible for use with any office or business machine which uses continuous paper or forms in a restricted work place.

Figure 6:
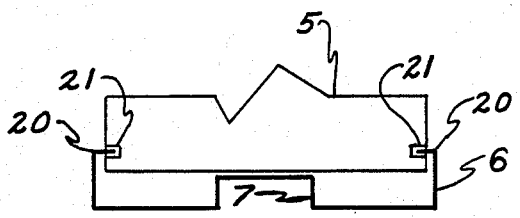
FIG. 6 is a top view of the supply paper restraint bail.
Figure 7:
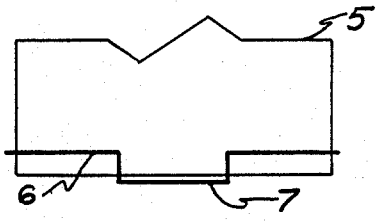
FIG. 7 is a front view of the supply paper restraint bail.
Figure 8:
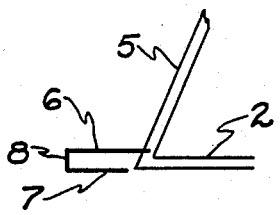
FIG. 8 is a side view of the supply paper restraint bail.
Figure 9:
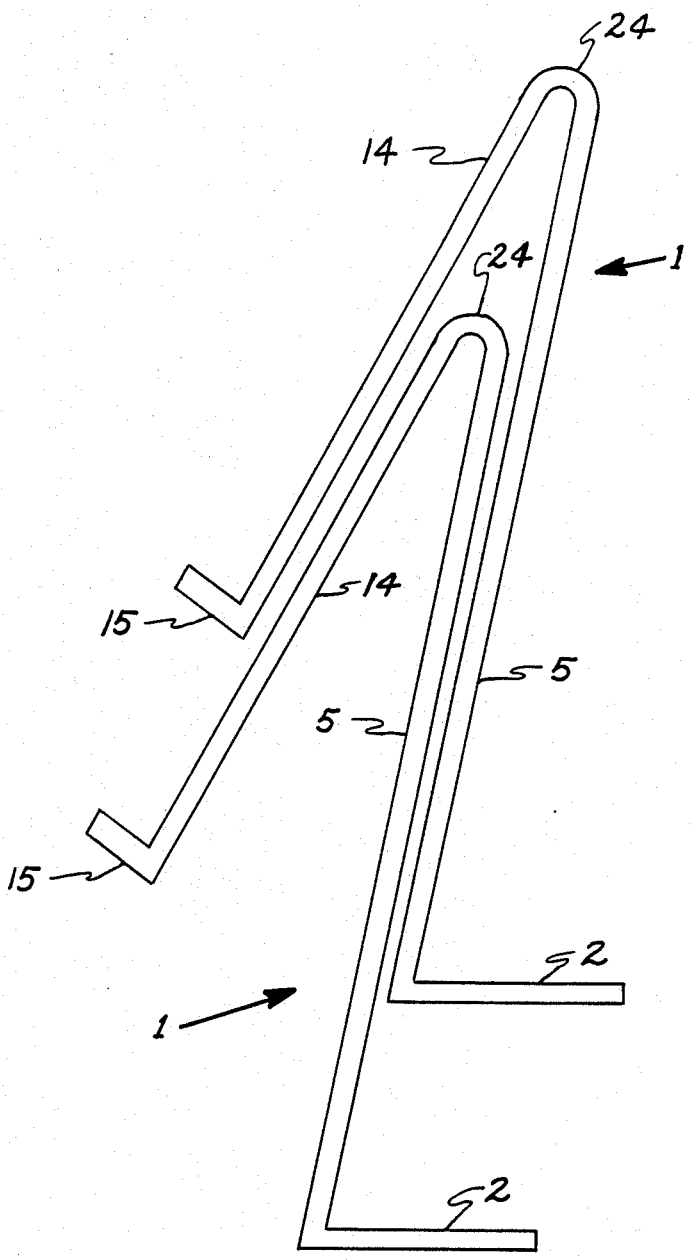
FIG. 9 illustrates the present invention in a stacked configuration.

The paper holder 1 is made of heat formable plastic and sits on a horizontal base 2. The supply paper 3 to be printed sits on the work surface 4 and rests against the supply paper tray 5 in a near vertical position. The supply paper 3 is restrained from sliding away from the paper holder at the bottom by the supply paper restraint bail 6. The shape of the supply paper restraint bail 6 is shown in FIG. 6, FIG. 7, and FIG. 8. The supply paper restraint bail 6 is bent in such a fashion that the supply paper 3 rests on the center bend 7. The weight of the supply paper 3 on the center bend 7 prevents the supply paper restraint bail 6 from moving and allowing the supply paper 3 to slide off the supply paper tray 5. The raised portion 8 of the supply paper restraint bail 6 prevents the supply paper 3 from sliding over the top of the supply paper restraint bail 6. The ends 20 of the supply paper restraint bails 6 are bent at approximately a 90-degree angle in the horizontal plane and inserted into holes 21 which are drilled into the sides of the supply paper tray 5. Attachment of the supply paper restraint bail 6 to the supply paper tray 5 by this manner allows the supply paper restraint bail 6 to rotate about a horizontal axis to a position which does not interfere with the stacking of multiple units as depicted in FIG. 9. The supply paper restraint bail 6 is fabricated of 1/16 inch diameter wire, but may be fabricated of any material which can be formed into a shape which will perform the required function.

Supply paper 3 is pulled from the supply paper tray 5 by the printer 9 and after printing, the paper is pushed by the printer into the printed output paper stack 10. The lower corner 27 of the printed output paper support leg 15 guides the paper as it is pulled from the supply paper tray 5. The printed output paper 11 passes under the printed output paper restraint bail 12 near the widest point 13 of the printed output paper restraint bail 12 shown in FIG. 2. The printed output paper stack 10 rests against the printed output paper collection tray 14 of the paper holder 1 in a near vertical position and is supported vertically by the printed output paper support leg 15.

The printed output paper restraint bail 12 is bent at each end 22 approximately 90 degrees in a horizontal plane and inserted in holes 23 drilled on each side of the printed output collection tray 14. Attachment of the printed output paper restraint bail 12 to the printed output paper collection tray 14 in this manner allows the printed output paper restraint bail 12 to rotate about a horizontal axis to accomodate packaging and multiple unit stacking. The printed output paper restraint bail 12 is fabricated from 1/16 inch diameter wire but may be fabricated from any material which can be formed into a shape which will perform the required function. The printed output paper restraint bail 12 contacts the printer 9 at a point 25 during operation. This allows the first sheet of printed output paper 11 to slide along the top of the printer 9 and go under the printed output paper restraint bail 12 at its widest point 13. The printed output paper restraint bail 12 decreases in width from its widest point 13 at the bottom to its most narrow point 26 at the top. This decrease in width with height restrains the printed output paper 11 as it is pushed up to the printed output paper stack 10.

The paper holder 1 is shaped such that the center of gravity of the paper holder 1, either empty or with paper in any of the storage positions, is in a vertical plane which lies between the front 16 of the base 2 and the back 17 of the base 2. Location of the center of gravity between the two points 16 and 17 prevents the holder from tipping over under any condition of usage. The angle u between the printed output paper support leg 15 and the printed output paper collection tray 14 is 90 degrees. The angle v between the printed output paper collection tray 14 and the supply paper tray 5 is between 0.0 degrees and 45 degrees, depending on the particular embodiment of the invention. The joint 24 connecting the printed output paper tray 14 and the supply paper tray 5 can be fabricated as a single bend as shown in FIG. 1 or with several other configurations as shown in FIG. 10-*a*, FIG. 10-*b*, and FIG. 10-*c*.

Figure 16:
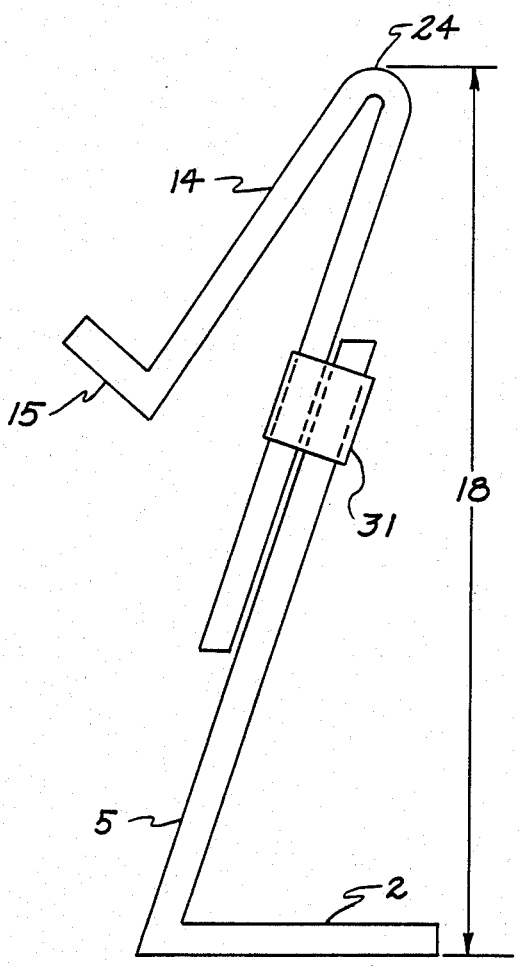
FIG. 16 is a side view of the present invention showing the configuration which allows the height of the present invention to be adjusted.
Figure 17:
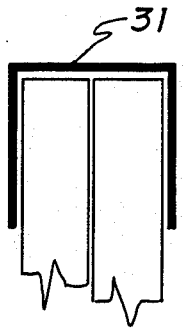
FIG. 17 is a top view of the variable height adjustment clamp.

The height 18 of the paper holder 1 varies depending on the height of the printer being used. As most of the conventional printers are approximately six inches in height, the height 18 of the paper holder 1 is in the range of fifteen to twenty inches in height. The width 19 is variable depending on the width of printer paper to be used. The invention will be fabricated in widths of 9.5 inches for standard 8.5-inch×11-inch paper and widths of fourteen inches for standard width computer paper. Each paper holder is fixed in its dimensions and the various sizes are manufactured as individual units or models but with the same basic shape. An alternate embodiment of the invention is shown in FIG. 16 where the height 18 of the paper holder 1 can be adjusted by changing the length of the supply paper tray 5 with the variable height adjustment clamp 31.

The paper holder 1 is shaped such that multiple units can be nested for storage and shipping. FIG. 9 shows two units in a stacked configuration.

Figure 1:
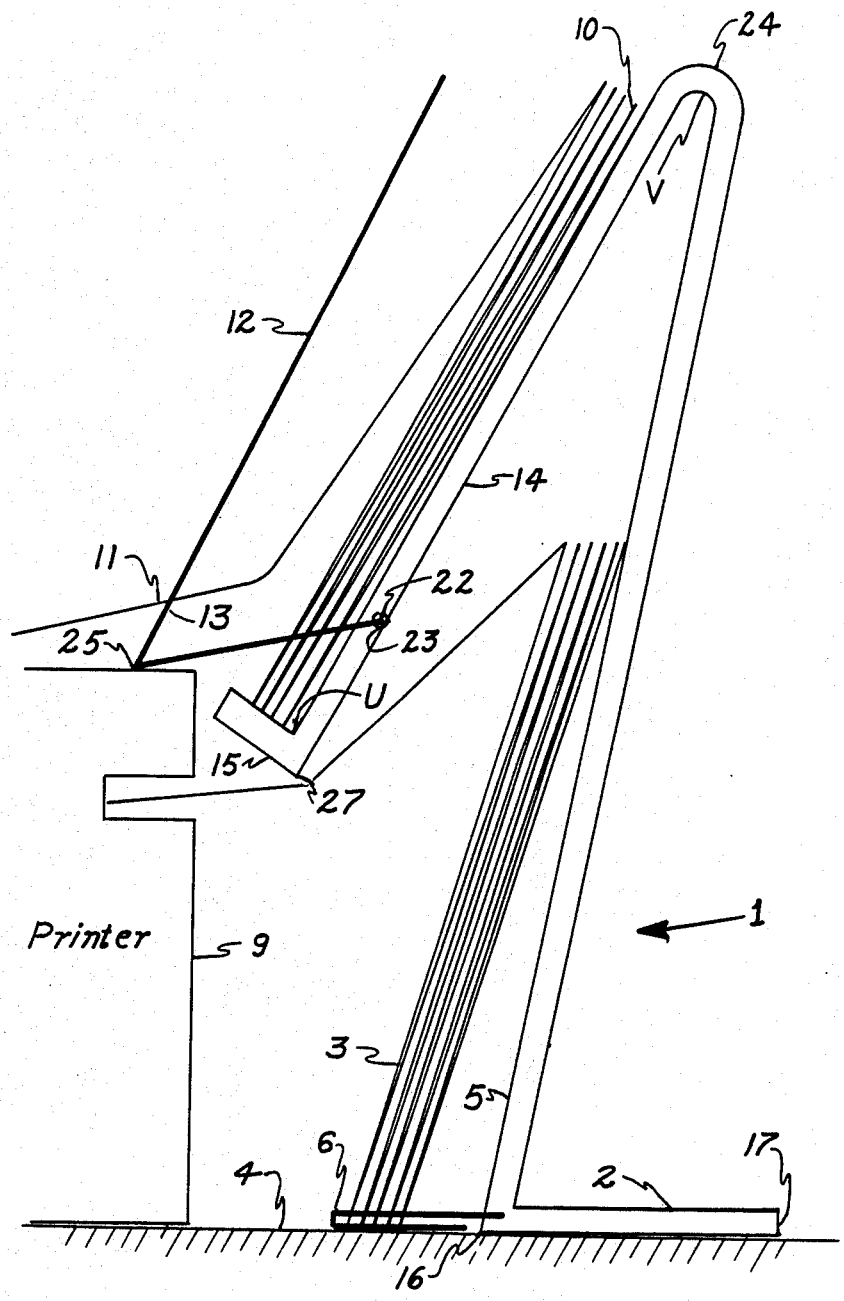
FIG. 1 is a side view of the present invention.
Figure 2:
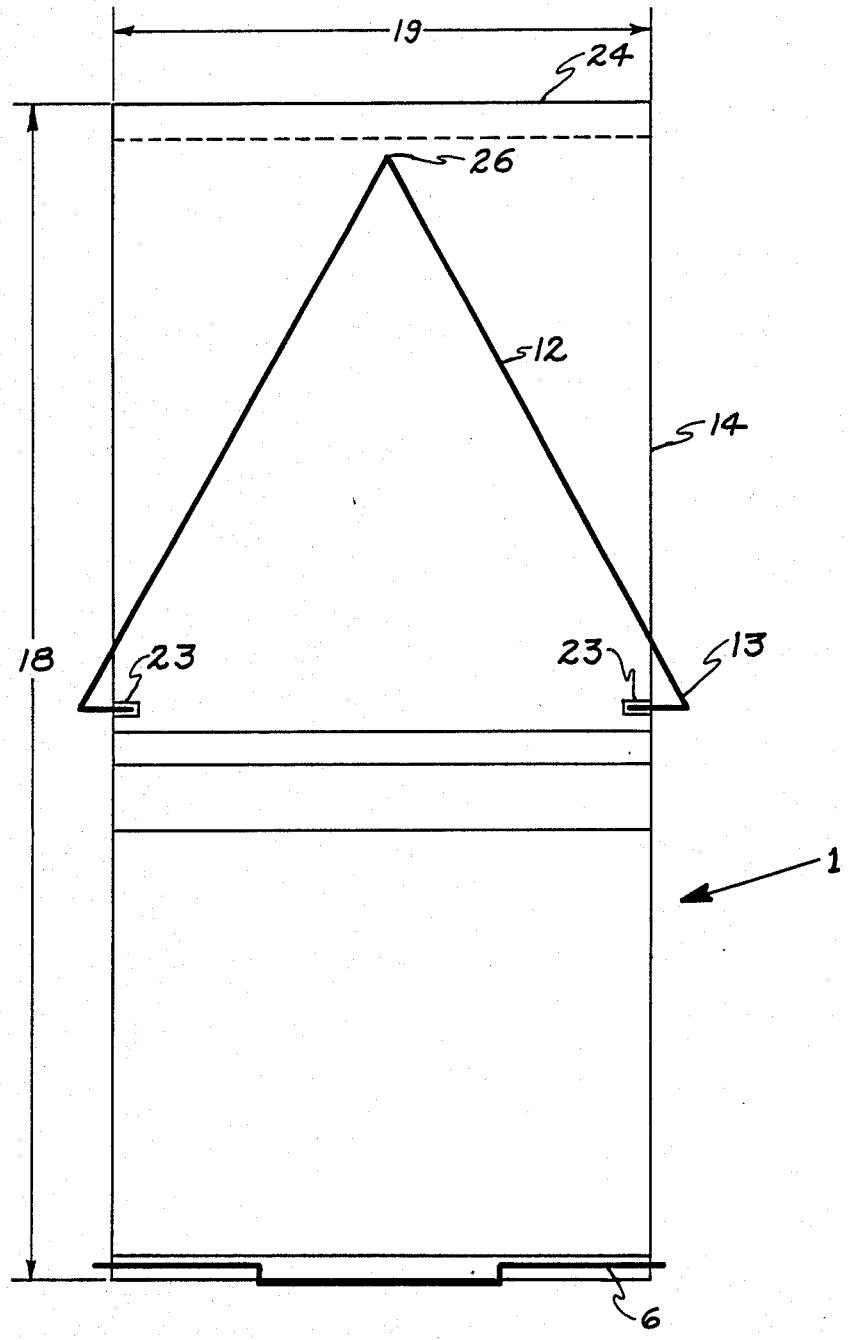
FIG. 2 is a front view of the present invention.
Figure 3:
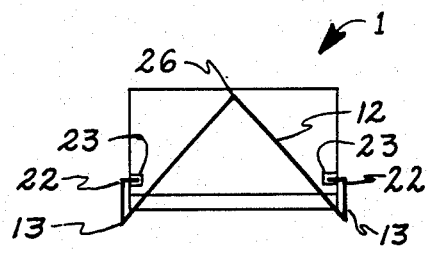
FIG. 3 is a top view of the printed output paper restraint bail.
Figure 4:
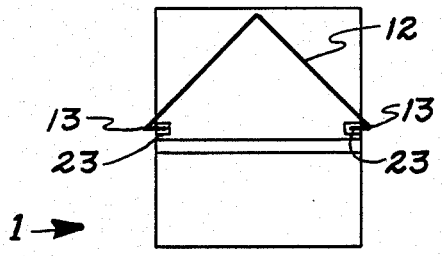
FIG. 4 is a front view of the printed output paper restraint bail.
Figure 5:
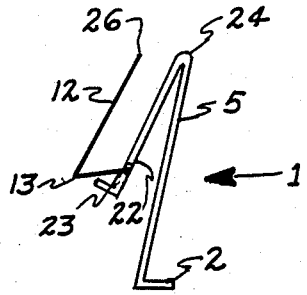
FIG. 5 is a side view of the printed output paper restraint bail.

The present invention may be constructed of any material which can be formed, molded, bent, welded, or joined in any manner to form the shape (more or less) depicted in FIGS. 1 and 2. The present invention may be constructed such that the finished product is one integral unit or it may be constructed such that the finished product can be separated into individual pieces at one or more joints. Construction of the present invention such that it can be separated at the top bend 24 makes it easier for the user to replenish the supply paper 3.

The joint 24 at the top of the paper holder 1 may have a variety of shapes as shown in FIG. 10-*a*, FIG. 10-*b*, and FIG. 10-*c*, including no joint at all for the embodiment shown in FIG. 11, FIG. 12, and FIG. 13 where the printed output paper collection tray 14 is supported by a panel 29 attached to the supply paper tray 5. In FIG. 10-*b*, the output paper collection tray 14 is shown connected to the supply paper tray 5 by use of a separate slotted connector 28. In FIG. 10-*c*, the output paper collection tray 14 is shown connected to the supply paper tray 5 by use of a slot formed as part 29 of the supply paper tray 5. Disclosure of the embodiment shown in FIG. 10-*c* is implied to include the configuration where the slot 29 is formed as part of the printed output paper collection tray 14.

The base 2 may be fabricated in the shape shown in FIG. 14 with an integral lip 30 to restrain the supply paper 3 and thus negate the need for the supply paper restraint bail 6. Embodiment of the present invention with the base in this configuration does not allow close stacking of the fabricated units as depicted in FIG. 9 of the preferred embodiment.

The paper holder 1 can be constructed to hold the supply paper 3 and the printed output paper stack 10 in a vertical position (the plane of the paper being at an angle of 90 degrees from the horizontal). This alternate embodiment of the invention requires that the base 2 be fabricated according to the embodiment shown in FIG. 14 in order for the paper holder 1 to be stable and stand without attachment to the printer 9. This alternate embodiment of the invention is shown in FIG. 15 and can be constructed to occupy the least amount of space behind the printer of all embodiments of the invention.

What is claimed is:

1. A paper holder for continuously feeding supply paper to a printer and for collecting printed output paper, wherein the supply paper and the printed output paper are both maintained in an orientation of between about 45° and 90° from horizontal, the holder comprising:

a. a base having a supply paper restraint bail affixed thereto in order to maintain the supply paper in said orientation of from between about 45° and 90° from horizontal;

b. a supply paper tray affixed to the base at an orientation of from between about 45° and 90° from horizontal;

c. a printed output paper collection tray affixed to the supply paper tray and oriented at from between about 45° and 90° from horizontal; and d. a printed output paper support leg affixed to a lower portion of the printed output paper collection tray.

2. A paper holder for continuously feeding supply paper to a printer and for collecting printed output paper, wherein the supply paper and the printed output paper are both maintained in an orientation of between about 45° and 90° from horizontal, the holder comprising:

a. a base;

b. a supply paper tray affixed to the base;

c. a printed output paper collection tray affixed to the supply paper tray and having a restraint bail to maintain the printed output paper in an upright position; and d. a printed output paper support leg affixed to the printed output paper collection tray.

3. In combination, a paper holder and a quantity of continuous paper, the paper holder comprising:

a. a base, b. a supply paper tray affixed to the base, c. a printed output paper collection tray affixed to the supply paper tray, and d. a printed output paper support leg affixed to the printed output paper collection tray;

the quantity of continuous paper comprising:

continuous supply paper folded upon itself at periodic predetermined fold points and maintained in said orientation of between about 45° and 90° from horizontal in the supply paper tray, the supply paper being continuously fed to a printer and thereafter collected in the printed output paper collection tray and maintained in said orientation of between 45° and 90° from horizontal as continuous printed output paper.

* * * * *